United States Patent [19]

Van Kesteren, Jr.

[11] 4,408,440

[45] Oct. 11, 1983

[54] APPARATUS FOR PACKING AND COMPRESSING FRESH SPINACH, OR THE LIKE

[76] Inventor: John Van Kesteren, Jr., P.O. Box 487, Onancock, Va. 23417

[21] Appl. No.: 290,541

[22] Filed: Aug. 6, 1981

[51] Int. Cl.[3] ..... B65B 1/24

[52] U.S. Cl. ..... 53/527; 53/238; 53/258; 53/260

[58] Field of Search ..... 53/527, 260, 530, 249, 53/258, 390, 202, 281, 238, 239; 100/220, 221, 224; 141/71, 73, 105, 283

[56] References Cited

U.S. PATENT DOCUMENTS

| | | | |
|---|---|---|---|
| 1,404,135 | 1/1922 | Myers | 53/239 |
| 3,369,339 | 2/1968 | Speiser | 53/35 |
| 3,479,795 | 11/1969 | Martin | 53/160 |
| 3,693,541 | 9/1972 | Lombard et al. | 100/137 |
| 3,824,759 | 7/1974 | Finn et al. | 53/529 |
| 3,958,700 | 5/1976 | Foy | 214/35 R |
| 4,019,547 | 4/1977 | Ross | 141/11 |
| 4,023,484 | 5/1977 | Schäfer | 100/215 |
| 4,065,910 | 1/1978 | Eiselt | 53/529 |
| 4,094,130 | 6/1978 | Kelly et al. | 53/529 |
| 4,162,603 | 7/1979 | Strömberg | 53/438 |
| 4,232,599 | 11/1980 | Ulrich | 100/25 |

*Primary Examiner*—Nicholas P. Godici
*Assistant Examiner*—Kurt Rowan
*Attorney, Agent, or Firm*—Charles S. McGuire

[57] ABSTRACT

A semi-automated apparatus and method for filling a basket with loose, fresh spinach and ice, compacting the spinach into the volume of the basket and retaining the spinach within the basket until a cover is secured thereon. The spinach and ice are gravity fed through a hopper and hollow, cylindrical guide, and a plunger is lowered through the guide to compress the spinach into an open basket directly below. The plunger face is grooved to accommodate a plurality of rods which are axially (longitudinally) advanced through the grooves and serve to hold the spinach in the basket as the plunger is retracted. The filled basket, with the retaining rods in place, is moved to a position laterally of the guide and a cover is secured in the usual manner by placing the wire basket handles over tabs extending from the circular cover. The rods are then axially retracted from between the spinach and basket cover. A laterally movable carriage holding two baskets is provided to allow a full basket to be covered, removed and replaced by an empty basket as another basket is being filled.

14 Claims, 6 Drawing Figures

APPARATUS FOR PACKING AND COMPRESSING FRESH SPINACH, OR THE LIKE

BACKGROUND OF THE INVENTION

The present invention relates to apparatus and methods for packing bulk materials in containers and, more specifically, to apparatus and methods for packing fresh, leafy vegetables such as spinach in baskets or other containers.

It is the usual practice for growers to pack freshly harvested spinach leaves in bushel baskets, or similar containers, together with a quantity of cracked ice for shipment to produce jobbers where the spinach is repacked in smaller quantities for distribution to retailers. For space-efficient shipment, the spinach must be compacted into a much smaller volume than the leaves normally occupy in their free, uncompacted state. The spinach may, of course, be compacted manually to a certain extent, but this is a very laborious process, resulting in uneven quantities of spinach being packed in the baskets.

In the closest prior art known to applicant, the spinach is compressed by a plunger, or similar device, and a circular weight is placed atop the compressed spinach to hold it in the basket until a cover is place thereon. The weight is manually removed from the top of the spinach as the cover is placed on the basket, which is a somewhat difficult and time-consuming task requiring careful coordination of weight removal and cover placement to prevent the spinach from expanding and spilling out of the basket. Thus, the packing of fresh spinach at the present state of the art has tended to be a labor-intensive operation.

It is a principal object of the present invention to provide a semi-automated method of packing leafy vegetables, and apparatus used in connection therewith, which greatly reduces the amount of labor involved in such operations.

Another object is to provide apparatus and methods for compacting bulky leaf vegetables such as spinach into a shipping container and allowing a retaining cover to be placed on the container quickly and easily without danger of the compacted leaves spilling out of the container during the operation.

A further object is to provide apparatus for and methods of packing predetermined quantities of leafy vegetables and cracked ice in a shipping container, such as a bushel basket, in less time and with less effort than through conventional apparatus and methods.

Other objects will in part be obvious and will in part appear hereinafter.

SUMMARY OF THE INVENTION

In accordance with the foregoing objects, the invention contemplates a packing method involving a series of steps some of which are, or may be, performed manually and others of which are performed by the apparatus of the invention under an operator's selective control. The steps include supporting in a predetermined position an open-topped container such as a bushel basket. A predetermined amount of fresh spinach in loose, uncompacted form is dropped into a hopper and through hollow, cylindrical guide means into the basket. A quantity of cracked ice is then dropped through the hopper, in response to manual actuation of a valve by the operator, following which a second predetermined quantity of loose spinach is fed through the hopper.

The quantities of spinach in loose form are sufficient to fill not only the basket, but all or a substantial portion of the hollow guide means directly above. Upon actuation of another valve, a plunger is lowered through the guide means to compress the spinach and ice into the volume of the basket. With the plunger in its lowered position, retaining means in the form of a plurality of parallel, elongated rods are extended longitudinally through recesses in the plunger to a position above the compacted spinach, thereby holding it in the basket as the plunger is moved back to its raised position. The filled basket with the spinach thus retained is moved to a position laterally of the filling position. A cover is then placed on the basket and secured in the usual manner by placing the wire basket handles over tabs extending from opposite sides of the cover. The retainer rods are then retracted, being pulled from between the spinach and the basket cover.

Further refinements to the apparatus of the invention include a movable skirt on the lower portion of the guide means, immediately above the upper end of the basket, and a reciprocating carriage for the basket supports, allowing a full basket to be covered and removed and replaced with an empty basket as another basket is being filled. These and other features of the invention will be more readily understood by reference to the following detailed description and accompanying drawings.

DETAILED DESCRIPTION

Figure 1:
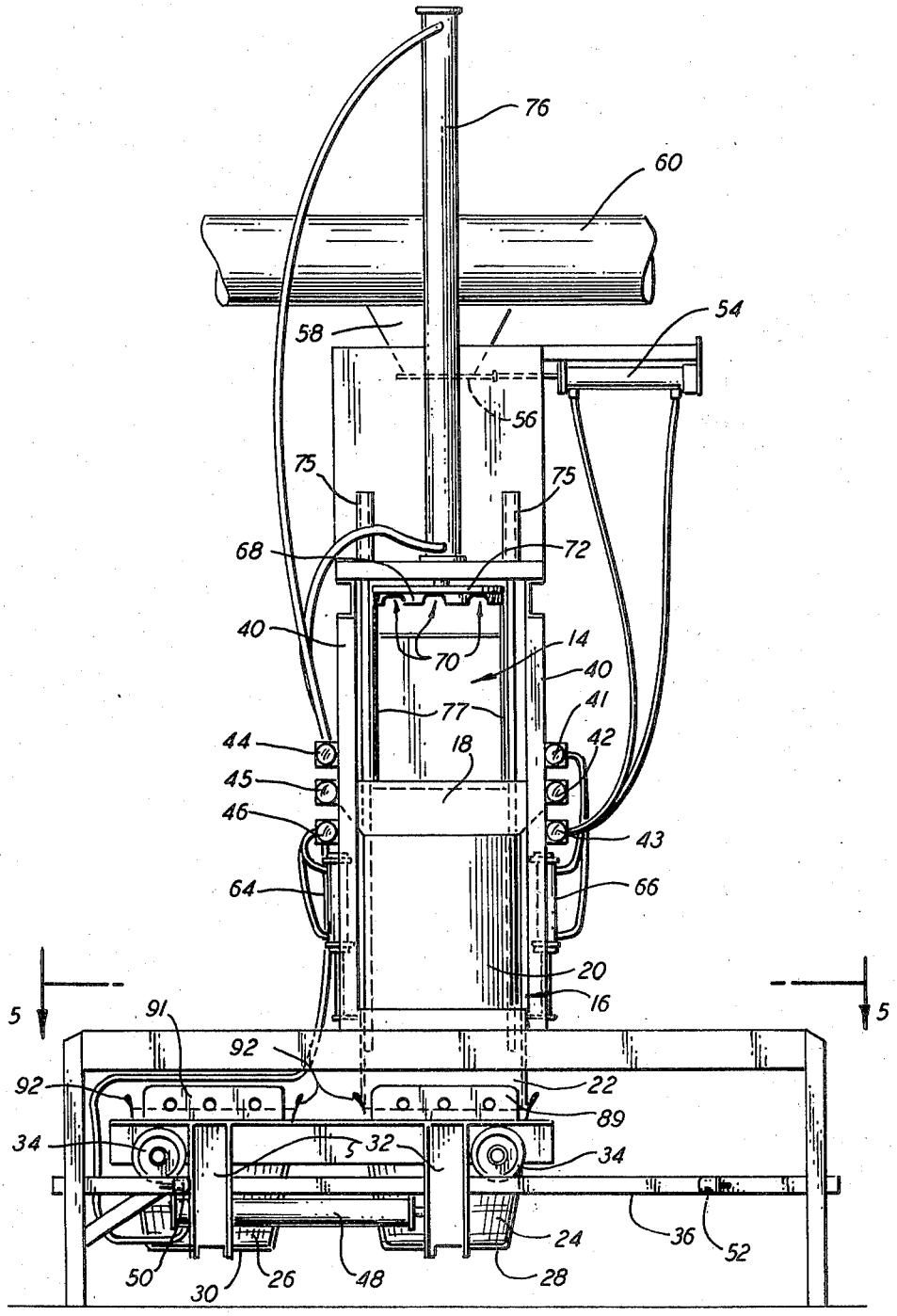
FIG. 1 is a front elevational view of the preferred embodiment of the apparatus of the invention.
Figure 2:
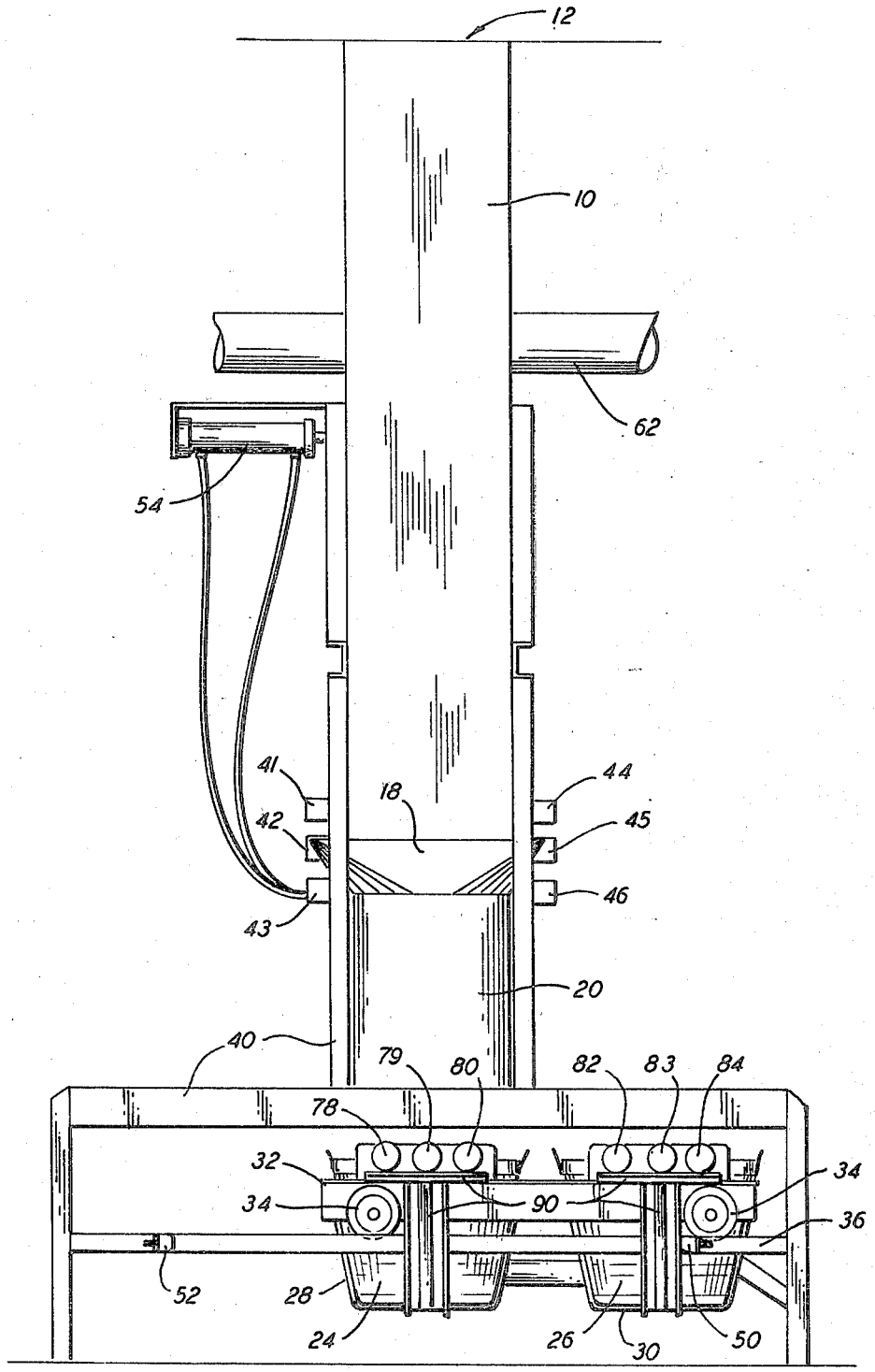
FIG. 2 is a rear elevational view.

The apparatus of the invention, in conjunction with which the method is carried out, includes a hopper and inclined chute denoted collectively be reference numeral 10. Freshly harvested, loose spinach is dropped into open, upper end 12 of hopper 10, slides down the chute and is discharged from lower end 14 into guide means denoted generally by reference numeral 16. Guide means 16 includes outwardly flared, open, upper end portion 18 joined to hollow, cylindrical body portion 20. Cylindrical skirt 22 encircles the lower end of body portion 20 and forms an axially movable lower end of guide means 16, as explained later in more detail.

The spinach which is fed into hopper 10 is first measured, preferably by weighing on scales (not shown) adjacent upper end 12 of the hopper. After unloading from the wagons in which it is harvested the spinach may be cleaned by passing over vibrating screens, and/or washed, visually inspected while transported by conveyor means for removal of foreign matter and other unwanted portions, and deposited on the scales. When the amount of spinach on the scales reaches a desired weight, e.g., 10 pounds, the loose spinach is pushed off the scales into hopper 10, falling through guide means 16 into an open-topped container such as bushel basket 24 positioned directly below the open lower end of skirt 22.

Figure 5:
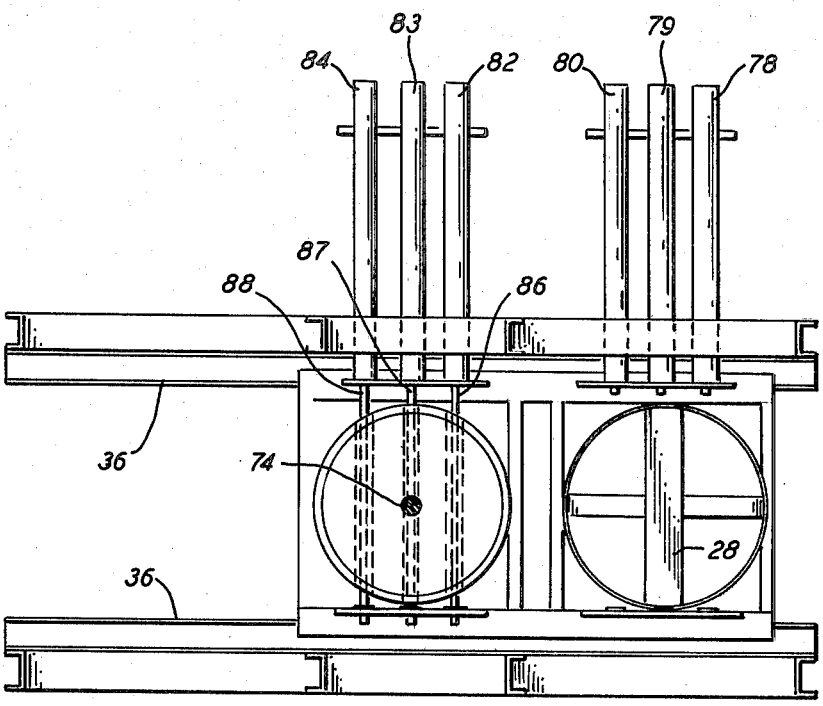
FIGS. 5 and 6 are top plan views of certain elements of the apparatus, taken on the line 5—5 of FIG. 1, showing the elements in different positions of their movement.

Basket 24 and a second basket 26 are positioned on a pair of holders 28 and 30 which are configured appropriately to the particular containers which are to be packed by the apparatus and methods of the invention. Standard bushel baskets, for example, are substantially cylindrical, having a diameter at the upper end of about 18" and a height of about 12". Accordingly, basket holders 28 and 30 may be formed as a circular band and underlying straps, as best seen in FIG. 5 where holder 28 is shown empty, i.e., without a basket supported therein.

Holders 28 and 30 are mounted on horizontally movable carriage means comprising frame members 32 and wheels 34. The carriage moves reciprocally on tracks 36, upon which wheels 34 rest, which are supported on legs 38. The latter are attached to the main frame, consisting of rigidly connected horizontal and vertical beams, each indicated by reference numeral 40. Guide means 16 are supported by members 39 which extend between upright beams 40 of the main frame.

The movable elements of the apparatus, both those earlier mentioned and those not yet described, are preferably moved by pneumatic cylinders under the control of manually operated valves. An air compressor of suitable capacity (not shown) provides pressurized air to each of the two-way valves which an operator selectively acuates to move the reciprocating cylinders in the desired direction. A total of six valves are mounted in vertical rows of three on upright beams 40 on each side of guide means 16 at the front of the apparatus, as seen in FIG. 1. Each valve has a manually engagable control knob, the six knobs being denoted by reference numerals 41–46. The air lines from the valves to the associated pneumatic cylinders have been omitted in certain Figures for greater clarity.

The carriage for basket holders 28 and 30 is moved by cylinder 48, under control of the valve actuated by knob 46. As shown in FIG. 1, the operating rod of cylinder 48 is fully retracted, positioning the carriage at the left end of its travel with basket 24 directly beneath guide means 16. Movement of knob 46 to the opposite position (each knob is movable between "in" and "out" positions, producing opposite movement of the associated cylinder(s)) supplies air to the left end of cylinder 48, moving the operating rod to the fully extended position. The carriage is thereby moved to position basket 26 directly under guide means 16 and basket 24 to the right thereof. Resilient bumpers 50 and 52 are attached to fixed brackets on one of tracks 36 to establish more precisely the limits of movement of the carriage.

Figure 3:
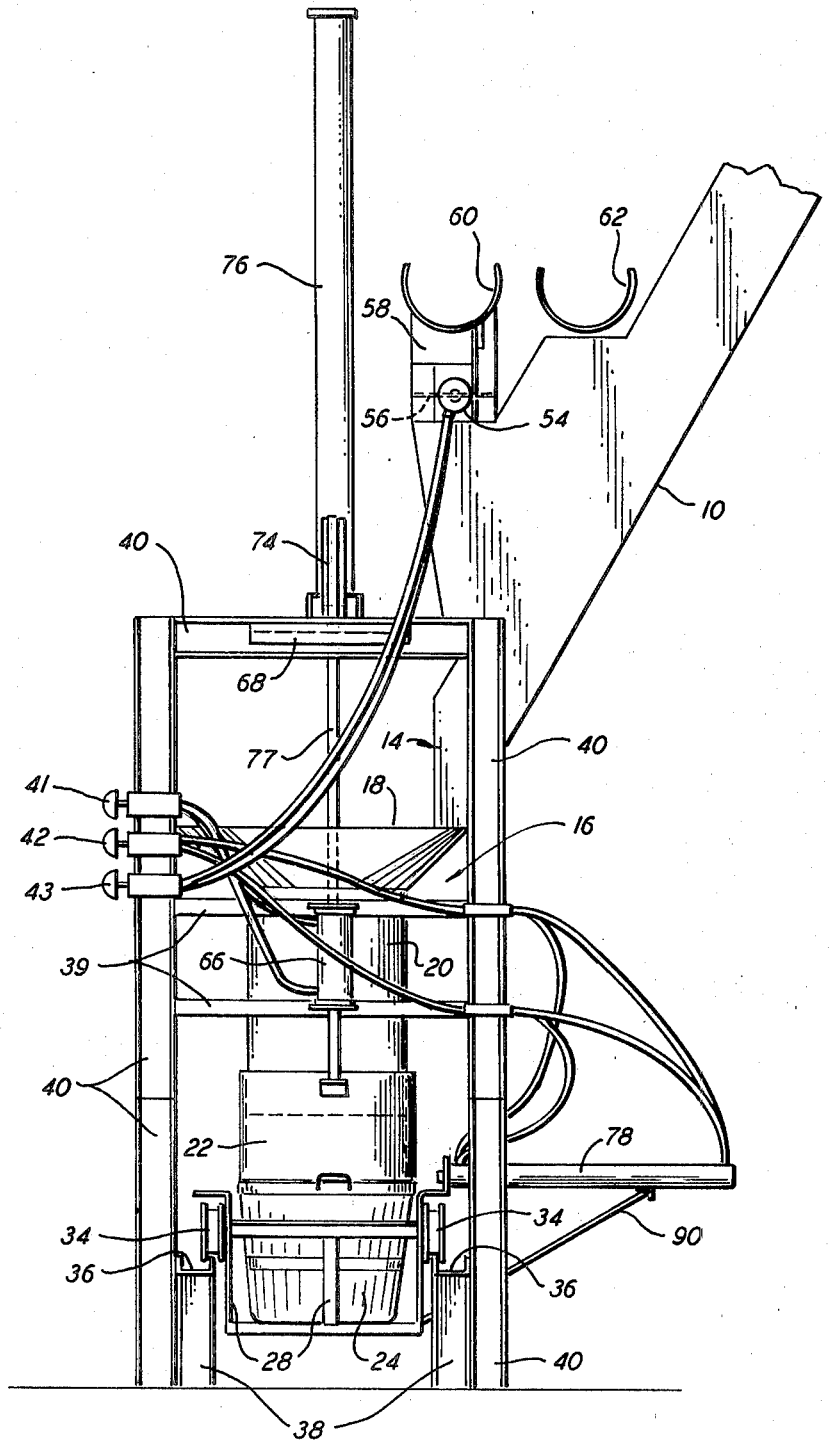
FIGS. 3 and 4 are side elevational views showing certain movable elements of the apparatus in two different positions.
Figure 4:
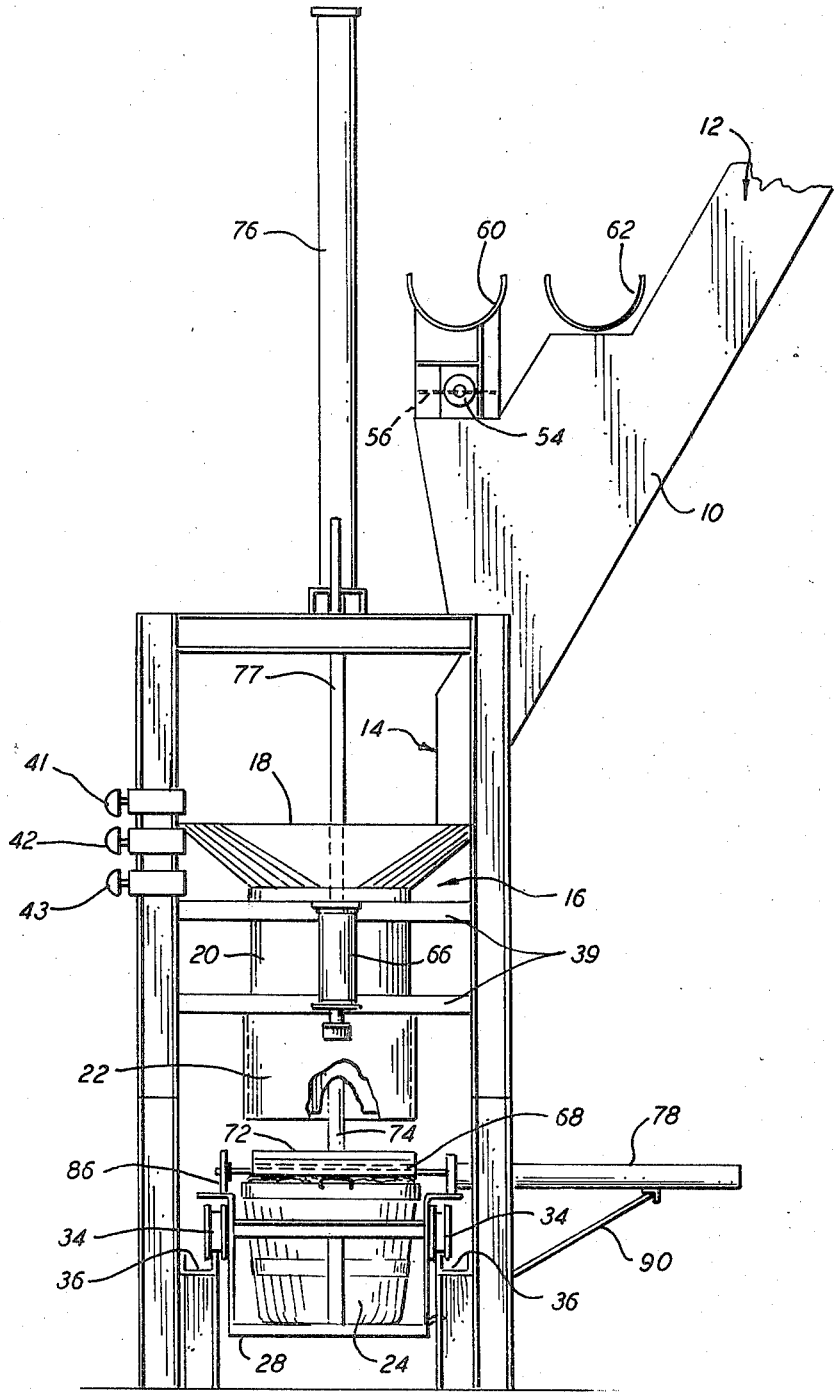

Cylinder 54 is movable under the control of valve 43 to move plate 56 between covering and uncovering positions with respect to the lower end of hopper 58. Return run 60 of a conveying system, supply run 62 of which is seen in FIGS. 3 and 4, communicates with the upper end of hopper 58. Cracked ice is deposited in supply run 62 at one end of the conveying system, and is carried therethrough by a conventional auger-type conveyor, undergoing a 180° change of direction at the opposite end. The volume of hopper 58 is such that it holds a desired, predetermined quantity of ice, e.g., 10 pounds, when full. Ice is delivered at a rate sufficient at least to fill hopper 58 during each cycle, any excess ice being carried by the conveyor over the top of the filled hopper. Thus, a measured amount of cracked ice is fed by gravity from hopper 58 through hopper and chute 10 to guide means 16 under control of the operator by movement of knob 43. If desired, of course, the ice may be fed automatically between feeding of the two quantities of spinach.

Previously mentioned cylindrical skirt 22 encircles the lower end of body portion 20 of guide means 16. Pneumatic cylinders 64 and 66 are supported on member 39 on each side of the guide means and the operating rod of each cylinder is attached to a bracket on skirt 22. Joint actuation of cylinders 64 and 66 is controlled by movement of knob 41. As the operating rods move between their retracted and extended positions, skirt 22 is moved between a raised position, wherein its lower end is approximately at the level of the lower end of body portion 20 (FIG. 4), and a lowered position, wherein its lower end is in close proximity to the upper end of a basket positioned below the guide means (FIG. 3). Skirt 22 may be, for example, on the order of 7 inches in height, and travel about 4 inches, having a diameter approximately equal to that of the upper ends of the baskets to be filled, i.e., 18 inches, which is slightly larger than the diameter of body portion 20 to allow free movement of the skirt.

A plunger mechanism is provided for compacting the loose spinach and ice into the volume of the basket below. In the illustrated embodiment, the mechanism includes circular, wooden plunger face 68, having three parallel grooves or recesses 70 in the downwardly facing surface thereof, attached to circular metal backing plate 72. The end of operating rod 74 of cylinder 76 is attached to the plunger face and backing plate preferably by a threaded connection which allows fine adjustment of the position of the plunger when the cylinder is at opposite ends of its movement, and with no parts extending into central groove 70 of plunger face 68.

Movement of cylinder 76 between the fully retracted (FIGS. 1 and 3) and fully extended (FIG. 4) positions of the operating rod, under operator control of knob 44, moves the plunger mechanism from a position above open end 14 of the chute to a position with its lower surface approximately in the plane of the upper end of a basket directly beneath guide means 16. Thus, the plunger mechanism does not interfere with the free gravity delivery of spinach and ice, being in the upper position when materials are fed from the chute into the guide means and basket. Likewise, movement of the plunger mechanism to the lower position is effective to compress all of the spinach which has been deposited in the guide means, together with the ice, into the volume of the basket, which is done with skirt 22 in its lower position. Movement of the plunger mechanism is preferably stabilized by members 75 affixed to the sides of the plunger riding in tracks or channels 77 on each side of, and extending into guide means 16.

Figure 6:
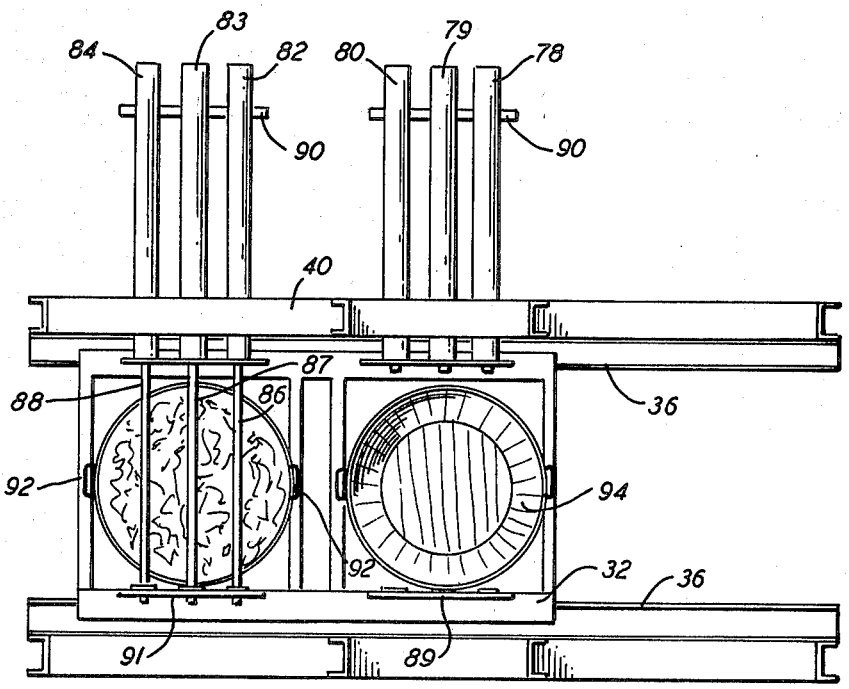

Mounted rearwardly of the carriage for reciprocating movement therewith are two sets of three pneumatic cylinders, all of which are parallel to one another and have equal travel. As best seen in FIGS. 5 and 6, the right-hand set of cylinders (as seen from the front or top of the apparatus), numbered 78, 79 and 80 are positioned adjacent basket holder 28, and the left-hand set of cylinders 82, 83 and 84 are positioned adjacent basket holder 30. The operating rods of each set of cylinders are spaced by a distance equal to the spacing of grooves 70 in plunger face plate 68 whereby, when the plunger mechanism is in its lower position, the operating rods pass longitudinally through the grooves as they are extended and retracted.

Operating rods 86, 87 and 88 of cylinders 82, 83 and 84, respectively, are shown in FIGS. 5 and 6 in the extended position, those of cylinders 78, 79 and 80 being retracted. In FIG. 5, the plunger mechanism is in the lower position, operating rod 74 being shown in section, and the portions of rods 86, 87 and 88 extending through grooves 70 below the plunger face being shown in hidden lines. All three cylinders of each set are actuated together, although the two sets are independently actuable, the right-hand and left-hand sets being controlled by movement of knobs 42 and 45, respectively. The ends of the rods in the right and left sets when fully extended are stabilized by extending into fixed guide means 89 and 91 respectively, on upper portions of horizontal frame member 32 of the carriage.

The major structural elements of the apparatus and manner of their operation having been thus described, a complete sequence of operations in the packing method will now be explained. Baskets are first placed in the holders provided therefor, and the process may be started with the carriage at either end of its travel. Assuming the carriage to be on the left, as seen from the front, basket 24 is positioned below the guide means and skirt 22 is in its lower position, as shown in FIG. 1. The first (10 lb.) quantity of spinach is fed through the hopper and chute into guide means 16 and basket 24. This quantity of loose spinach will normally fill the basket and a portion of the guide means. The operator then pulls knob 43 out to release the ice in hopper 58, and immediately pushes the knob back in to re-cover the bottom of hopper 58 and allow ice to accumulate therein for the next cycle. If more than the measured quantity of ice is desired, the operator can leave hopper 58 uncovered for a short time to allow additional ice to fall through the hopper as it is moved through the conveying system. The second (10 lb.) quantity of spinach is fed from above, independently of operator control, as previously mentioned, which will fill a substantial portion of guide means 16 with loose spinach and ice.

The operator then moves knob 44 to cause cylinder 76 to extend operating rod 74, moving the plunger mechanism downwardly through the guide means, and compacting all of the spinach and ice into basket 24. Knob 41 is then moved to raise skirt 22, with the plunger remaining in place. Cylinders 78, 79 and 80 are then actuated by movement of knob 42 to extend their operating rods through grooves 70 in plunger face 68. The operator then moves knob 44 again to retract rod 74 and return the plunger mechanism to its upper position. The spinach, having been compacted by the plunger into the volume of the basket, will be retained therein by the rods when the plunger face is lifted, the rods thus providing an effective retainer means for the compacted spinach.

The operator then moves knob 46 to actuate cylinder 48 and move the carriage from left to right. Cylinders 78, 79 and 80 (as well as the cylinders of the left set), being supported by brackets 90 which are attached to the carriage, move therewith and continue to prevent the spinach from expanding and spilling out of basket 24. Now basket 26 is positioned below the guide means and the operator moves knob 41 to lower skirt 22 so that spinach delivered through the hopper and chute will be retained in basket 26 and in the guide means.

In the meantime, a second operator places a lid on basket 24 over the top of both the compacted spinach and the operating rods of cylinders 78, 79 and 80. The two tabs which extend outwardly from opposite sides of the conventional bushel basket lid (not shown) are secured under the wire handles 92 on the basket. The first operator then moves knob 42 to retract the rods of cylinders 78, 79 and 80 which are simply pulled from between the spinach in the basket and the lid secured thereon. The second operator then removes the filled, covered basket 24, now ready for shipment, from holder 28 and the elements are as shown in FIG. 5.

One of the operators replaces basket 24 with an empty basket 94 as the spinach and ice are being deposited and compacted in basket 26. After rods 86, 87 and 88 are extended and the plunger mechanism has been raised, knob 46 is again moved to cause the carriage to move to its left-hand position, with the rods remaining in place, and the elements are as shown in FIG. 6. The second operator then moves to the left side of the apparatus and places a lid on basket 26, which is removed from holder 30 upon retraction of rods 86, 87 and 88, and is replaced with another empty basket. In the meantime, basket 94 has been filled, and the process continues. Although the process may obviously be carried out with a single operator, it has been found that the use of two operators for each piece of apparatus in the manner described results in a more efficient, less error-prone operation.

From the foregoing, it may be seen that the invention provides both improved methods of packing leafy vegetables into containers for shipment and novel apparatus useful in carrying out such packing methods. It is obviously feasible, if desired, to automate the process to a much greater degree than that described. For example, position-responsive or other known switching devices may be installed to initiate operations of the apparatus in response to completion of other operations, such as a switch operated at termination of downward movement of the plunger to actuate cylinders 64 and 66 to move skirt upwardly, termination of which could operate a second switch for extending the retainer rods of the apporpriate set of three cylinders, movement of which would cause upward travel of the plunger, which would cause movement of the carriage, etc.

What is claimed is:

1. Apparatus for assisting in packing compressible, leafy vegetables, or the like, into covered containers, said apparatus comprising:

(a) means for supporting an open-topped container with its upper end at a first location;

(b) hollow guide means having a cross section substantially corresponding to that of said container upper end and extending upwardly from a position immediately above said first location to guide said vegetables deposited into said guide means to said container;

(c) plunger means movable through said guide means between a first position above said guide means and a second position immediately above the open top of said container at said first location, whereby downward travel of said plunger means serves to compress said vegetables within said container and guide means into the volume of said container;

(d) retainer means movable between a first position laterally adjacent said open top of said container at said first location and a second position in contacting and partial covering relation to said compressed vegetables in said container with said plunger means in its second position, said retainer means being effective to retain said compressed vegetables within said container to allow placing a cover thereon after movement of said plunger means back to said first position thereof and prior to movement of said retainer means back to its first position;

said guide means including a movable portion forming the lower end thereof, said portion being movable between a lower position immediately adjacent the upper end of a container at said first location, wherein said portion is in the path of movement of said retainer means, and an upper position out of the path of movement of said retainer means; and (f) means operable to move said plunger means and said retainer means between said first and second positions of each.

2. The invention according to claim 1 and further including manually operable control members for each of said plunger and retainer moving means.

3. The invention according to claim 1 wherein said guide means is substantially cylindrical, open at the top and bottom.

4. The invention according to claim 1 and further including means for transporting said supporting means horizontally between said first location of the container and a laterally adjacent second location.

5. The invention according to claim 4 wherein said supporting means includes a pair of spaced holders for supporting two containers, one of which is in said first location when the other is in said second location thereof.

6. The invention according to claim 5, and further including a pair of said retaining means, each mounted upon and movable with said transporting means for operation in conjunction with the container on one of said holders.

7. The invention according to claim 1 wherein said retainer means comprises a plurality of axially movable rods.

8. The invention according to claim 7 wherein said plunger means includes recessed portions through which said rods travel in moving from said first to said second position with said plunger means in its second position.

9. The invention according to claim 1 and further including means for gravity feeding a predetermined quantity of ice into said guide means at selected intervals.

10. The invention according to claim 9 and further including an inclined chute having a lower end positioned for discharge into the upper end of said guide means and separate inlets for receiving said vegetables and said ice for gravity feed into said guide means.

11. The invention according to claim 3 wherein said plunger means comprises a downwardly facing, circular plunger face slightly smaller in diameter than said cylindrical guide means, and a plurality of spaced, parallel grooves extending into and across said plunger face.

12. The invention according to claim 11 wherein said retainer means comprises a plurality of parallel pneumatic cylinders each having an operating rod, said rods being laterally spaced by distances equal to the spacing of said plunger face groove and movable through said groove as said rods are extended and retracted with said plunger face in said second position thereof.

13. Apparatus for assisting in packing compressible, leafy vegetables, or the like, into covered containers, said apparatus comprising:

(a) means for supporting an open-topped container at a first location;

(b) hollow guide means extending upwardly from a position immediately above said first location to guide materials into said container;

(c) plunger means movable through said guide means between a first position above said guide means and a second position immediately above the open top of said container at said first location, whereby downward travel of said plunger means serves to compact compressible materials within said container and guide means into the volume of said container;

(d) retainer means comprising a plurality of elongated rods, axially movable between a first position laterally adjacent the top of said container at said first location and a second position in contacting and partial covering relation to the materials in said container with said plunger means in its second position, said retainer means being movable between portions of said plunger means and compressed materials within said container to allow placing a cover thereon after movement of said plunger means back to said first position thereof and prior to movement of said retainer means back to its first position;

(e) said guide means being substantially cylindrical, open at the top and bottom, and including a vertically movable skirt at the lower end thereof, means operable to move said skirt between a lower position, wherein the lower end of said skirt is in close proximity to the upper end of a container at said first location, in the path of movement of said rods, and an upper position, wherein said lower end is spaced from said container upper end, out of the path of movement of said rods; and (f) means operable to move said plunger means and said retainer means between said first and second positions of each, and to move said skirt between said lower and upper positions thereof.

14. The invention according to claim 13 wherein said means operable to move said plunger means, said retainer means and said skirt all comprise pneumatic cylinders having individual, manually operable control members.

* * * * *